US007115000B1

(12) United States Patent
Huang

(10) Patent No.: US 7,115,000 B1
(45) Date of Patent: Oct. 3, 2006

(54) CONNECTION DEVICE FOR SIGNAL WIRE

(76) Inventor: Chao-Chun Huang, 2F, No. 22, Liao Ning Rd., Taichung (TW)

( * ) Notice: Subject to any disclaimer, the term of this patent is extended or adjusted under 35 U.S.C. 154(b) by 0 days.

(21) Appl. No.: 11/209,602

(22) Filed: Aug. 23, 2005

(51) Int. Cl.
*H01R 4/30* (2006.01)
*H01R 4/38* (2006.01)

(52) U.S. Cl. ..... 439/801; 439/427

(58) Field of Classification Search ..... 439/78, 439/801, 810, 792, 793, 427, 430, 811, 812, 439/709

See application file for complete search history.

(56) References Cited

U.S. PATENT DOCUMENTS 2,059,467 A * 11/1936 Lowenstein ..... 337/235
2,246,356 A * 6/1941 Graham ..... 200/507
3,021,503 A * 2/1962 Hopkins et al. ..... 439/733.1
3,609,215 A * 9/1971 Giger et al. ..... 174/88 B
4,875,876 A * 10/1989 O'Loughlin ..... 439/431
4,886,940 A * 12/1989 Gagnon et al. ..... 174/88 B
5,993,267 A * 11/1999 Lin ..... 439/709
6,435,888 B1 * 8/2002 Reed, Jr. ..... 439/213
6,855,012 B1 * 2/2005 An ..... 439/793

* cited by examiner

*Primary Examiner*—Tulsidas C. Patel
*Assistant Examiner*—Vladimir Imas
(74) *Attorney, Agent, or Firm*—Charles E. Baxley

(57) ABSTRACT

A connection device for a signal wire includes at least one electrically conducting plate, at least one first holding member mounted on a first side of the electrically conducting plate, at least one second holding member mounted on a second side of the electrically conducting plate, and at least one locking member extended through the first holding member, the electrically conducting plate and the second holding member to clamp the electrically conducting plate between the first holding member and the second holding member. Thus, the first holding member and the second holding member are mounted on and removed from the signal wire by tightening or loosening the locking member, so that the connection device is attached to and detached from the signal wire easily and rapidly.

17 Claims, 10 Drawing Sheets

CONNECTION DEVICE FOR SIGNAL WIRE

BACKGROUND OF THE INVENTION

1. Field of the Invention

The present invention relates to a connection device, and more particularly to a connection device for a signal wire.

2. Description of the Related Art

A signal wire is used for the anti-theft purpose. The signal wire includes an insulating layer, and a metal strip mounted in the insulating layer to transmit a signal. In assembly, the signal wire is secured to a determined place, such as the door, window or the like. In such a manner, a safety system supplies an electric power to the signal wire to detect an abnormal signal from the metal strip. Thus, when a person pulls the door or the window intentionally, the signal wire is broken, so that the metal strip is vibrated and produces an abnormal signal that is detected by the safety system which emits a warning signal to the security so as to achieve the anti-theft purpose. However, the metal strip of the signal wire is secured to a metal plate by soldering so that it is difficult to mount the signal wire to the door or the window, thereby causing inconvenience to the worker and wasting the working time and manual work.

SUMMARY OF THE INVENTION

The present invention is to mitigate and/or obviate the disadvantage of the conventional connection device.

The primary objective of the present invention is to provide a connection device, wherein the first holding member and the second holding member are mounted on and removed from the signal wire by tightening or loosening the locking member, so that the connection device is attached to and detached from the signal wire easily and rapidly.

Another objective of the present invention is to provide a connection device, wherein the clamping portions of the first holding member press the electrically conducting plate so that the electrically conducting portion of the electrically conducting plate is connected to the metal foil of the signal wire closely.

A further objective of the present invention is to provide a connection device, wherein the electrically conducting portion of the electrically conducting plate has a sword-headed shape so that the electrically conducting plate is inserted into the signal wire rapidly, thereby facilitating the user attaching the connection device to the signal wire.

A further objective of the present invention is to provide a connection device, wherein the two terminal units are connected with each other by a single electrically conducting plate without needing addition parts, thereby decreasing the cost of assembly and saving the manual work.

In accordance with the present invention, there is provided a connection device, comprising at least one electrically conducting plate, at least one first holding member mounted on a first side of the electrically conducting plate, at least one second holding member mounted on a second side of the electrically conducting plate, and at least one locking member extended through the first holding member, the electrically conducting plate and the second holding member to clamp the electrically conducting plate between the first holding member and the second holding member.

Further benefits and advantages of the present invention will become apparent after a careful reading of the detailed description with appropriate reference to the accompanying drawings.

DETAILED DESCRIPTION OF THE INVENTION

Figure 1:
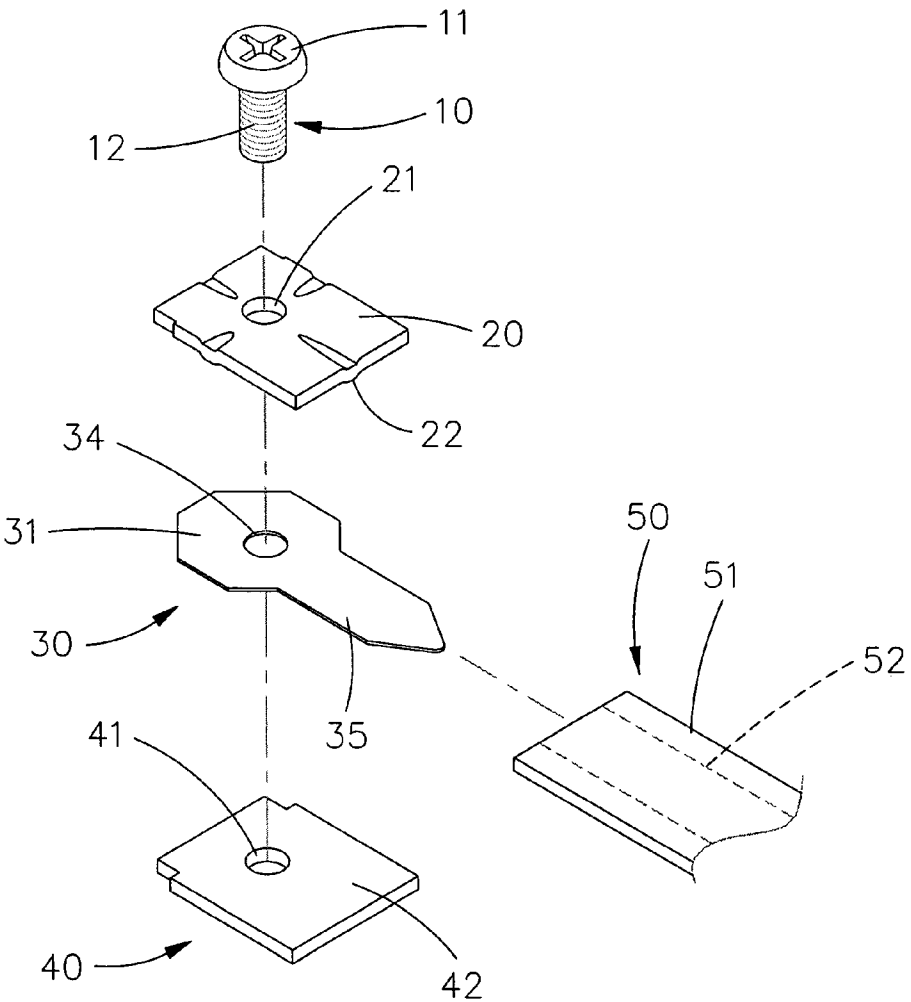
FIG. 1 is an exploded perspective view of a connection device in accordance with the preferred embodiment of the present invention.
Figure 2:
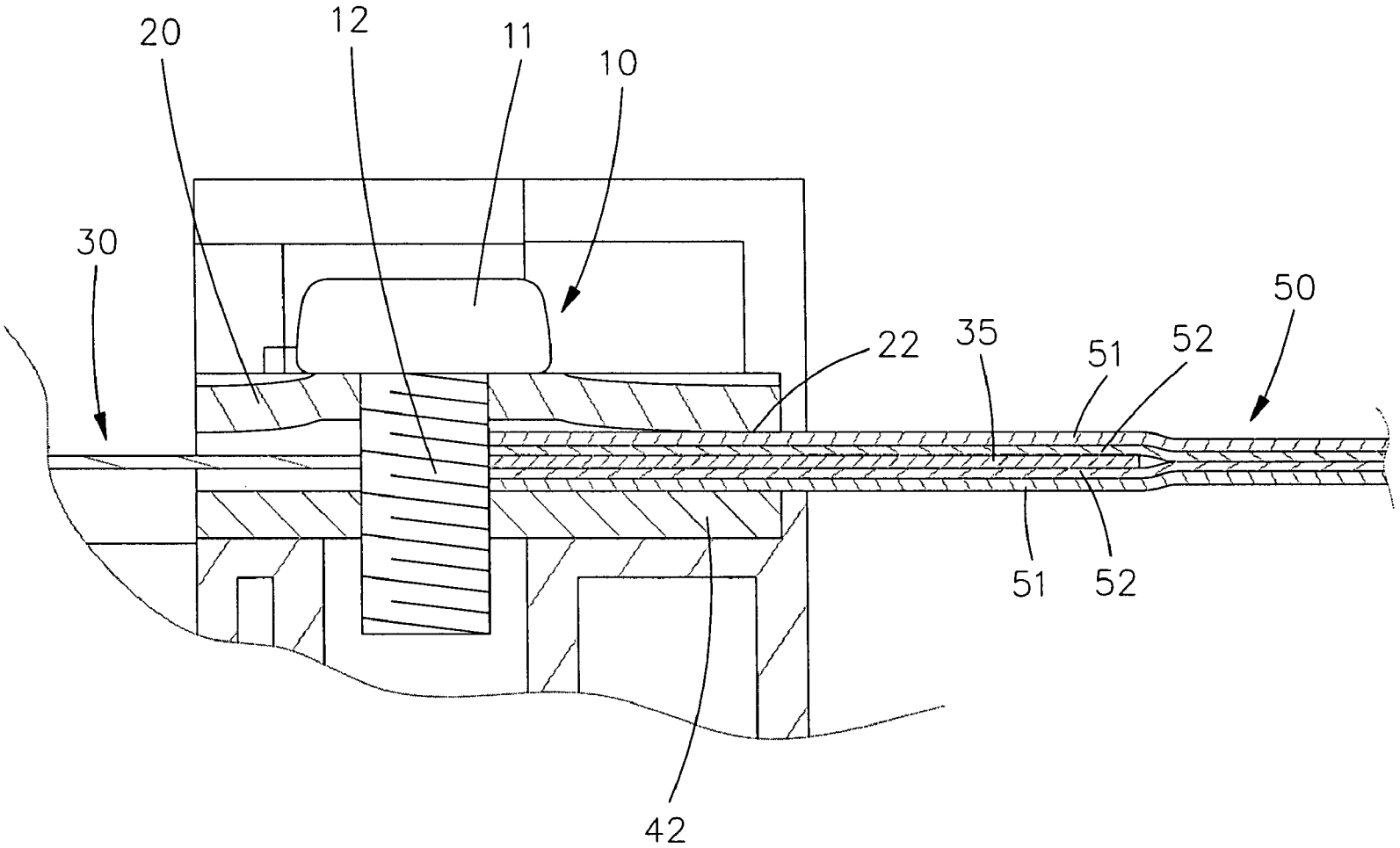
FIG. 2 is a plan cross-sectional assembly view of the connection device as shown in FIG. 1.
Figure 3:
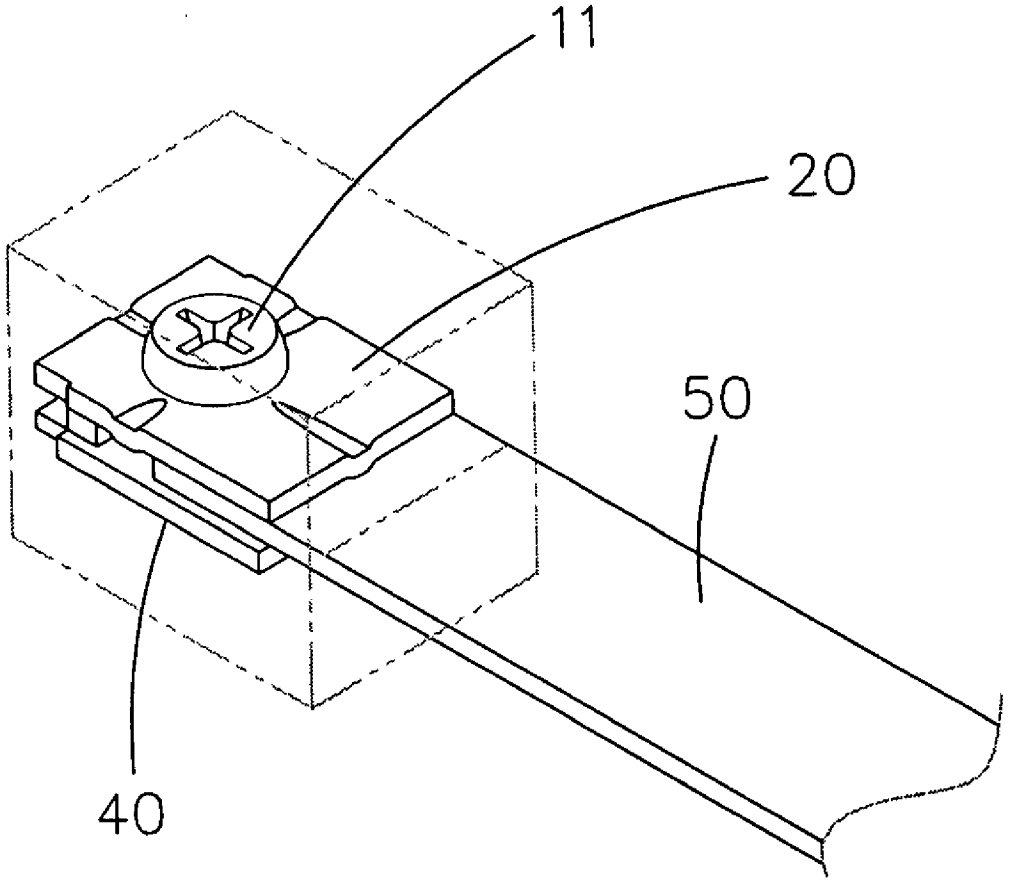
FIG. 3 is a perspective assembly view of the connection device as shown in FIG. 1.

Referring to the drawings and initially to FIGS. 1–3, a connection device in accordance with the preferred embodiment of the present invention comprises at least one electrically conducting plate 30, at least one first holding member 20 mounted on a first side of the electrically conducting plate 30, at least one second holding member 40 mounted on a second side of the electrically conducting plate 30, and at least one locking member 10 extended through the first holding member 20, the electrically conducting plate 30 and the second holding member 40 to clamp the electrically conducting plate 30 between the first holding member 20 and the second holding member 40.

In the preferred embodiment of the present invention, the connection device comprises an electrically conducting plate 30, a first holding member 20 mounted on a first side of the electrically conducting plate 30, a second holding member 40 mounted on a second side of the electrically conducting plate 30, and a locking member 10 extended through the first holding member 20, the electrically conducting plate 30 and the second holding member 40 to clamp the electrically conducting plate 30 between the first holding member 20 and the second holding member 40.

The first holding member 20 is made of a metallic plate having a through hole 21 and having a face formed with a plurality of protruding clamping portions 22 rested on the first side of the electrically conducting plate 30.

The electrically conducting plate 30 has a mounting portion 31 having an end formed with an electrically conducting portion 35 having a sword-headed shape. The mounting portion 31 of the electrically conducting plate 30 has a through hole 34.

The second holding member 40 is made of a metallic plate having a through hole 41 and having a face formed with a clamping portion 42 rested on the second side of the electrically conducting plate 30.

The locking member 10 is a locking bolt having a head 11 rested on the first holding member 20 and a threaded shank 12 extended through the through hole 21 of the first holding member 20, the through hole 34 of the electrically conducting plate 30 and the through hole 41 of the second holding member 40.

When in use, the locking member 10 is tightened or loosened to drive the first holding member 20 and the second holding member 40 to clamp or release the electrically conducting plate 30 so that the electrically conducting plate 30 can be inserted into and removed from a signal wire 50.

The signal wire 50 has a periphery provided with an insulating layer 51 and an inside provided with at least one metal foil 52 located in the insulating layer 51. In the preferred embodiment of the present invention, the signal wire 50 has two metal foils 52.

In assembly, the locking member 10 is loosened or unscrewed so that the electrically conducting plate 30 is inserted into the signal wire 50, and the electrically conducting portion 35 of the electrically conducting plate 30 is electrically connected to the metal foil 52 of the signal wire 50. At this time, the first holding member 20 and the second holding member 40 are rested on the insulating layer 51 of the signal wire 50. Then, the locking member 10 is tightened to press the first holding member 20 and the second holding member 40 so that the signal wire 50 is clamped by the first holding member 20 and the second holding member 40, and the electrically conducting portion 35 of the electrically conducting plate 30 is electrically connected to the metal foil 52 of the signal wire 50 constantly. In addition, the clamping portions 22 of the first holding member 20 press the electrically conducting plate 30 so that the electrically conducting portion 35 of the electrically conducting plate 30 is connected to the metal foil 52 of the signal wire 50 closely. In addition, the first holding member 20 and the second holding member 40 are mounted on and removed from the signal wire 50 by tightening or loosening the locking member 10, so that the connection device is attached to and detached from the signal wire 50 easily and rapidly.

Figure 4:
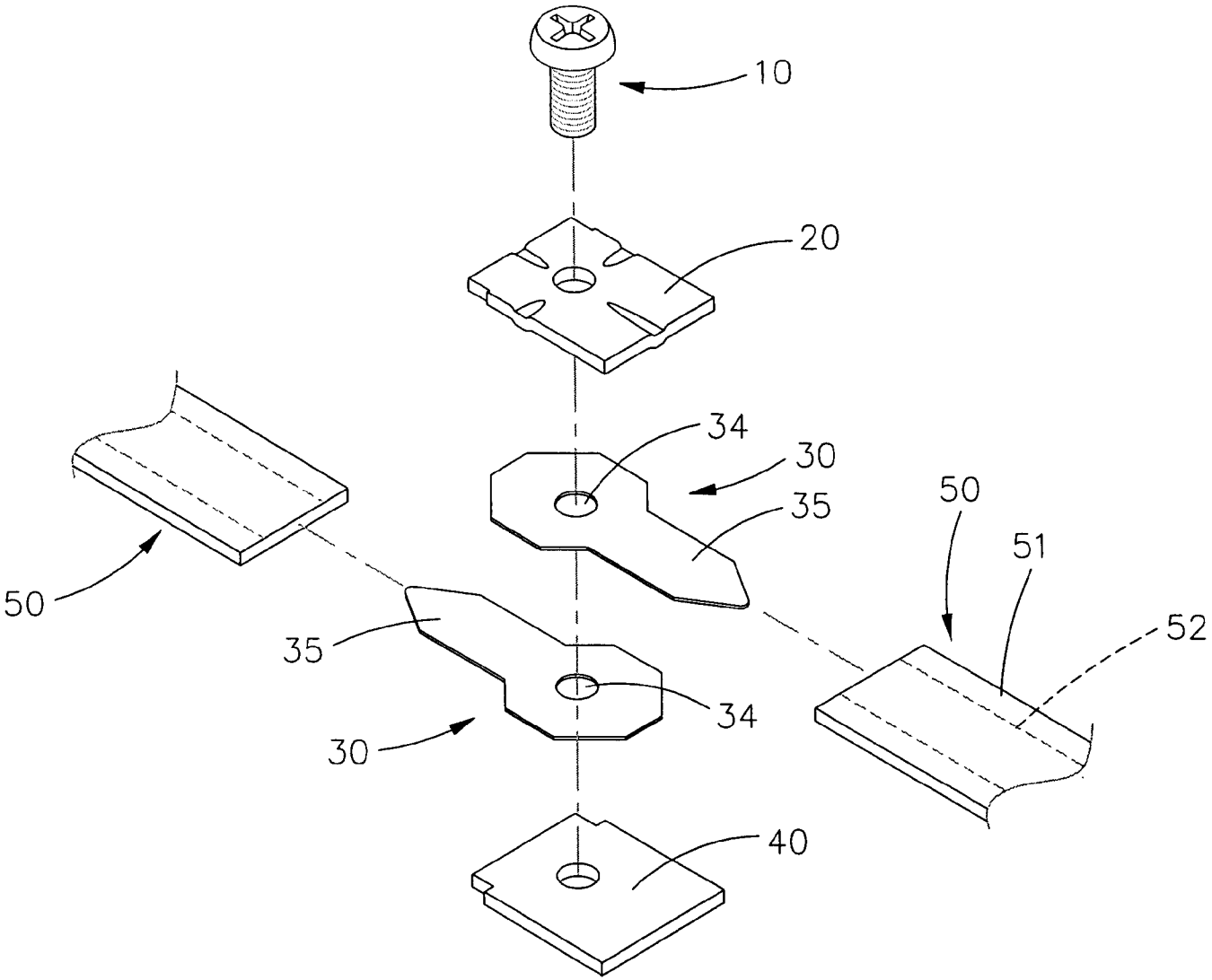
FIG. 4 is an exploded perspective view of a connection device in accordance with another preferred embodiment of the present invention.

Referring to FIG. 4, the connection device comprises two electrically conducting plates 30 laminating each other, a first holding member 20 mounted on a first one of the electrically conducting plates 30, a second holding member 40 mounted on a second one of the electrically conducting plates 30, and a locking member 10 extended through the first holding member 20, the electrically conducting plates 30 and the second holding member 40 to clamp the electrically conducting plates 30 between the first holding member 20 and the second holding member 40. In addition, the electrically conducting portions 35 of the electrically conducting plates 30 are directed toward two opposite directions. Thus, each of the two electrically conducting plates 30 can be inserted into and removed from a signal wire 50, so that the connection device is connected to two signal wires 50.

Figure 5:
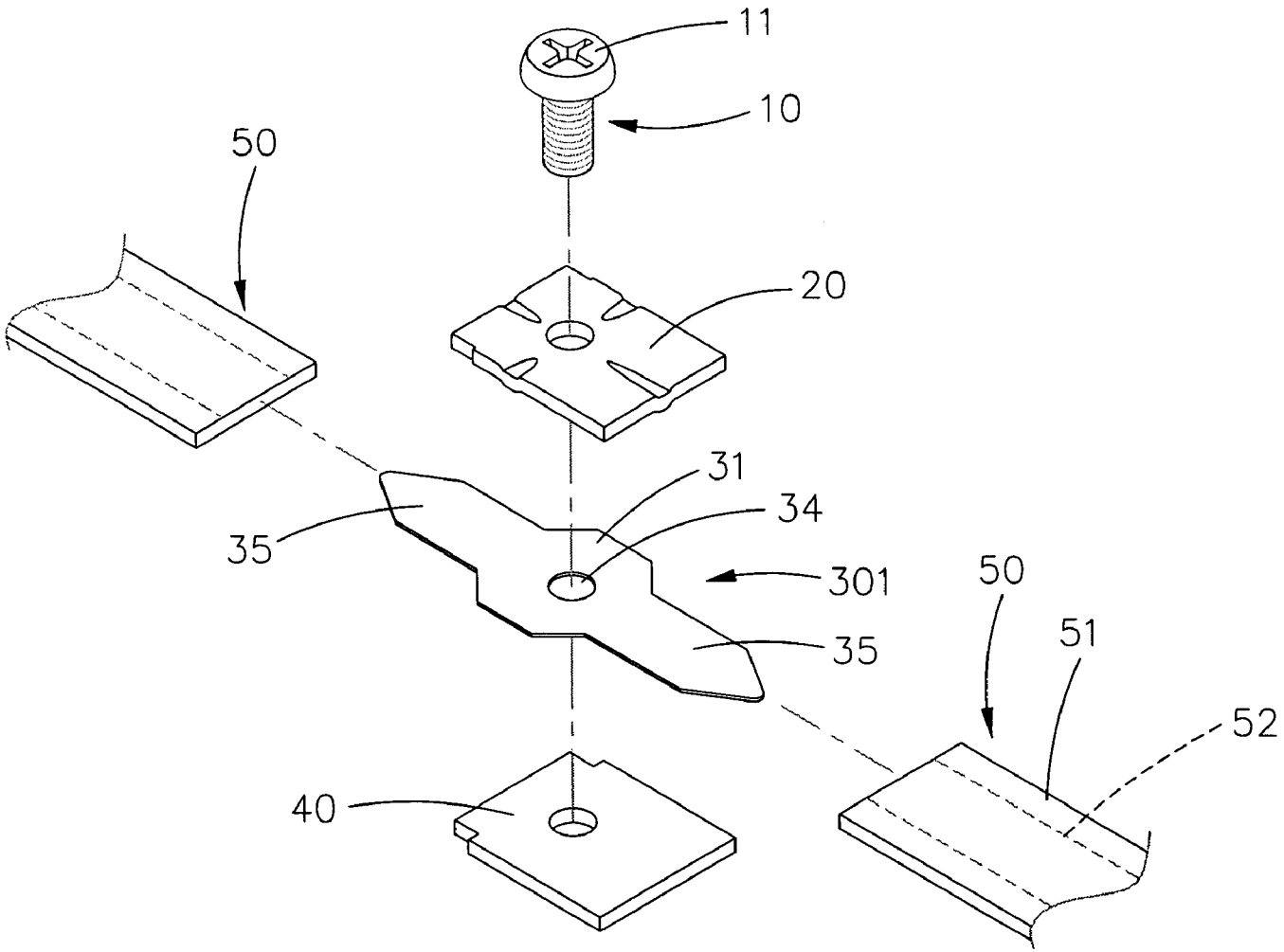
FIG. 5 is an exploded perspective view of a connection device in accordance with another preferred embodiment of the present invention.

Referring to FIG. 5, the electrically conducting plate 301 has a mounting portion 31 having two opposite ends formed with two opposite electrically conducting portions 35. Thus, each of the electrically conducting portions 35 of the electrically conducting plates 301 can be inserted into and removed from a signal wire 50, so that the connection device is connected to two signal wires 50.

Figure 6:
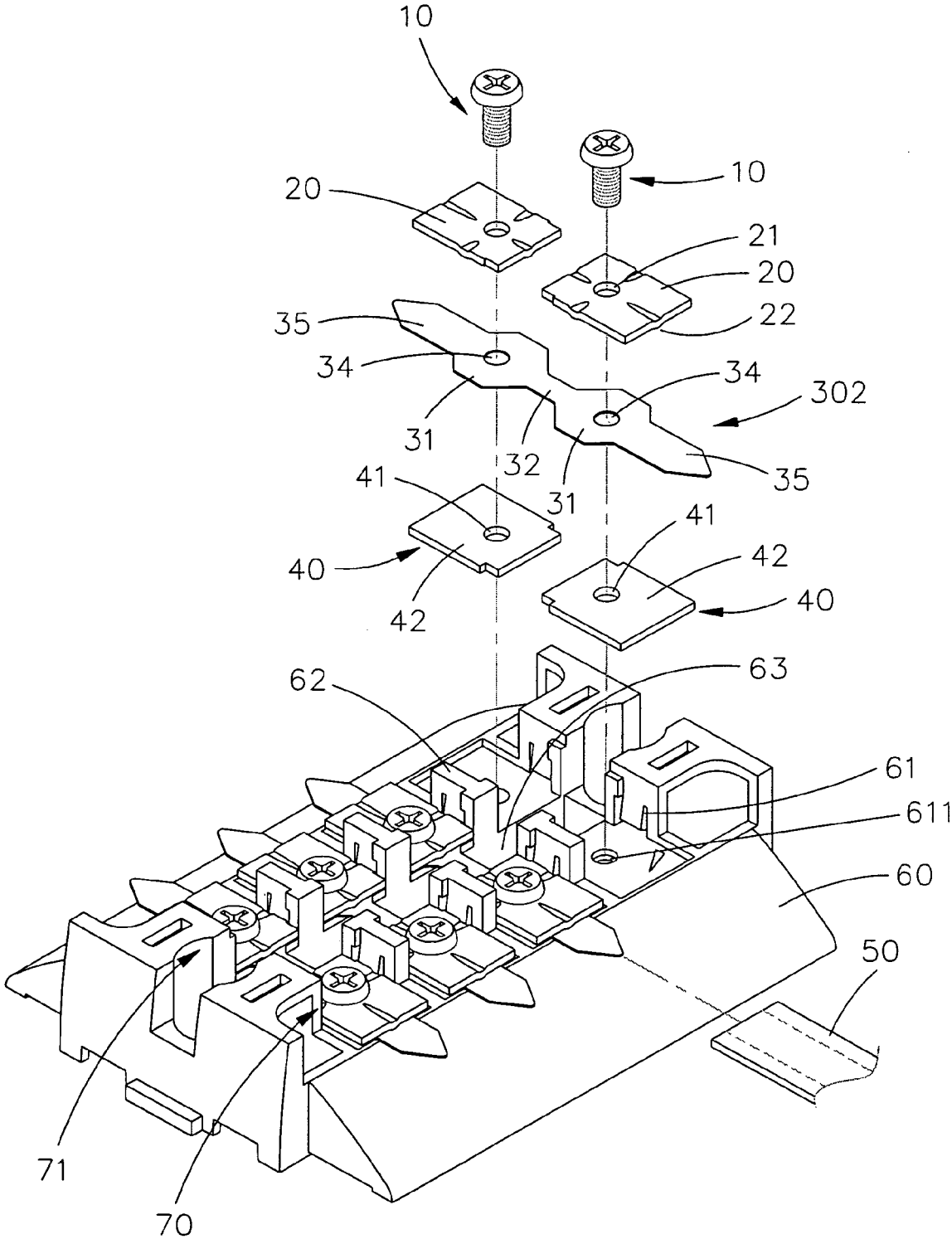
FIG. 6 is an exploded perspective view of a connection device in accordance with another preferred embodiment of the present invention.
Figure 7:
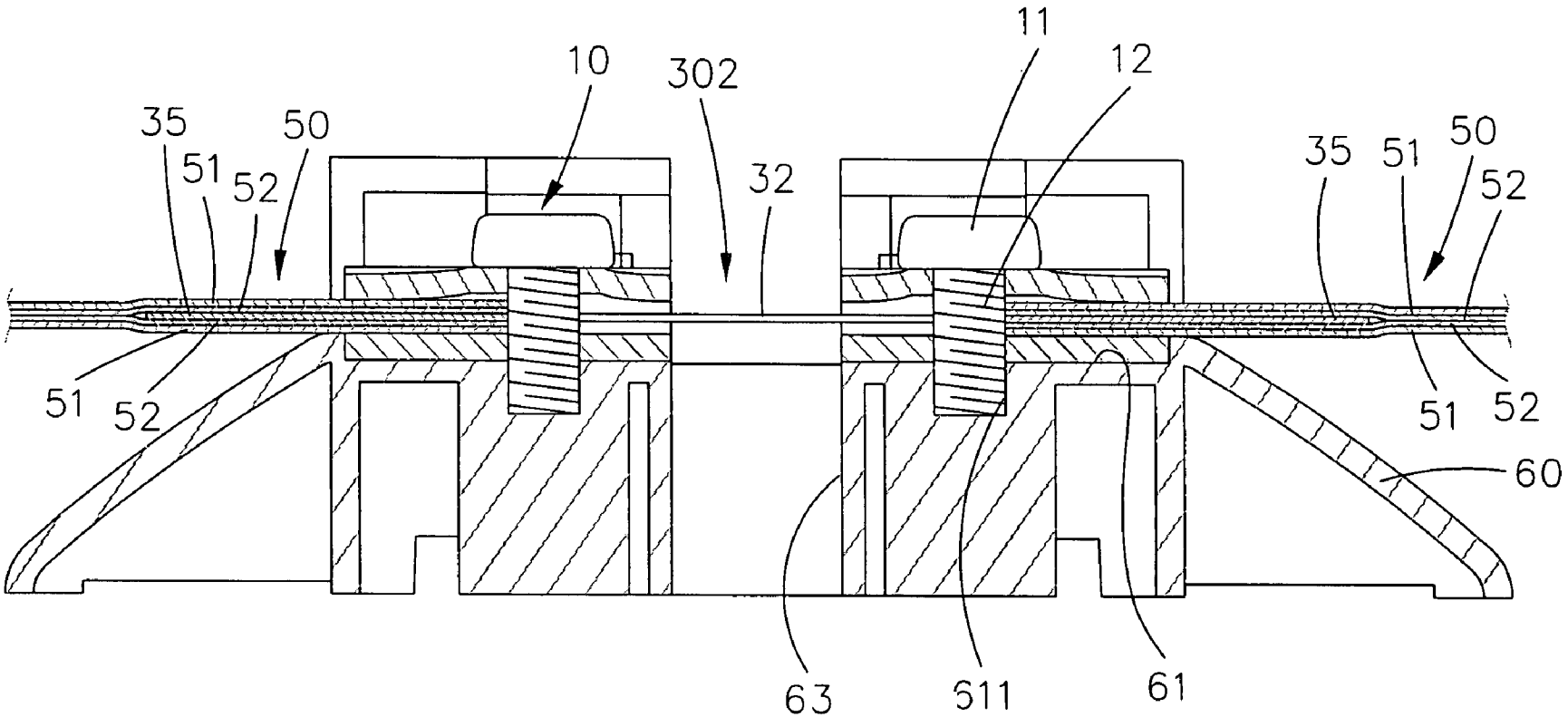
FIG. 7 is a plan cross-sectional assembly view of the connection device as shown in FIG. 6.
Figure 8:
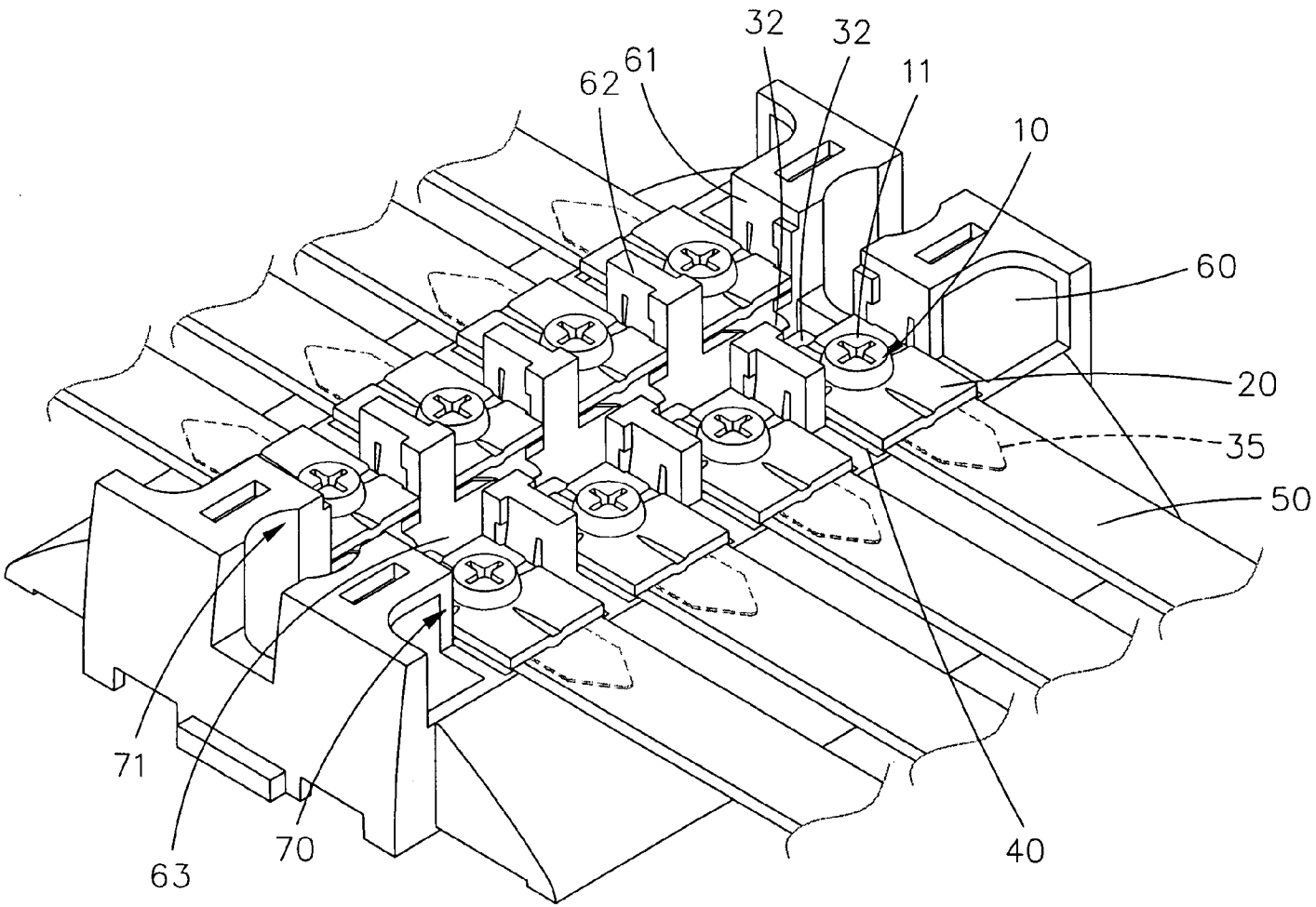
FIG. 8 is a perspective assembly view of the connection device as shown in FIG. 6.

Referring to FIGS. 6–8, the connection device comprises an electrically conducting plate 302, two first holding members 20 mounted on a first side of the electrically conducting plate 302, two second holding members 40 mounted on a second side of the electrically conducting plate 302, and two locking members 10 each extended through the respective first holding member 20, the electrically conducting plate 302 and the respective second holding member 40 to clamp the electrically conducting plate 302 between the first holding members 20 and the second holding members 40. The electrically conducting plate 301 has two mounting portions 31 each having an end formed with an electrically conducting portion 35, and a connection portion 32 located 1 between the two mounting portions 31. Each of the two mounting portions 31 of the electrically conducting plate 302 has a through hole 34.

A plurality of connection devices are mounted on a signal terminal station 60 for connecting a plurality of signal wires 50. The signal terminal station 60 has two opposite sides each having a plurality of connecting channels 61 for mounting the connection devices and a plurality of separation walls 62 located between the connecting channels 61, and a separation channel 63 located between the two opposite sides and connected to the connecting channels 61 for mounting the connection portion 32 of the connection device. Each of the connecting channels 61 has a bottom wall formed with a screw bore 611 for screwing the respective locking member 10. Each of the connection devices is mounted in the connecting channels 61 of the signal terminal station 60 for connecting two signal wires 50, and each of the two second holding members 40 is received in the respective connecting channel 61 of the signal terminal station 60. Thus, the two opposite sides of the signal terminal station 60 co-operate with the connection devices and the signal wires to form two terminal units 70 and 71.

As shown in FIGS. 7 and 8, the two terminal units 70 and 71 are connected with each other by the connection portion 32 of the electrically conducting plate 302 of the connection device.

Figure 9:
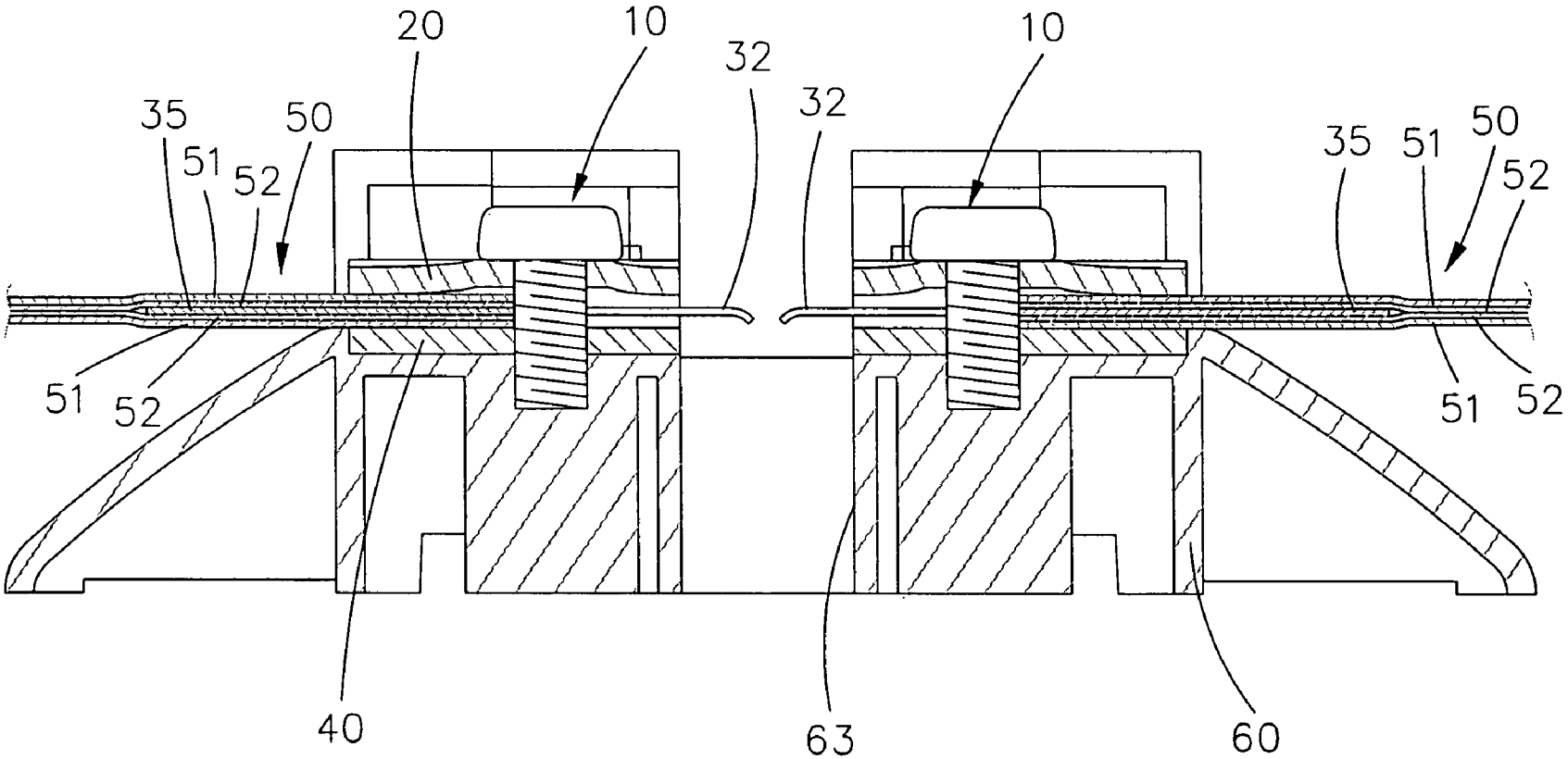
FIG. 9 is a schematic operational view of the connection device as shown in FIG. 7.

As shown in FIG. 9, the connection portion 32 of the connection device is cut to interrupt the connection between the two terminal units 70 and 71.

Figure 10:
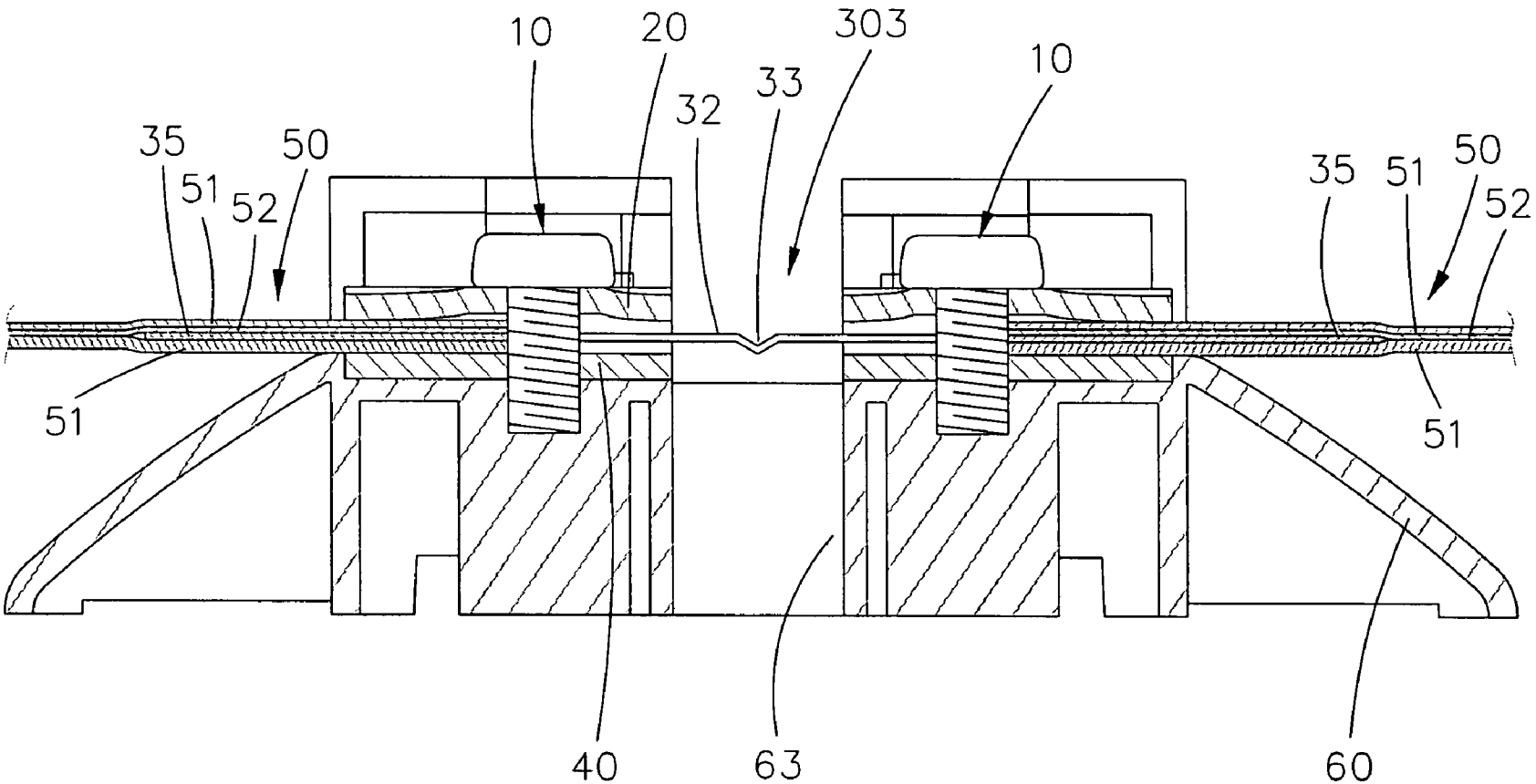
FIG. 10 is a plan cross-sectional assembly view of a connection device in accordance with another preferred embodiment of the present invention.

As shown in FIG. 10, the connection portion 32 of the electrically conducting plate 303 of the connection device has a mediate portion formed with a V-shaped dent 33 that can be broken by a user so as to interrupt the connection between the two terminal units 70 and 71.

Accordingly, the first holding member 20 and the second holding member 40 are mounted on and removed from the signal wire 50 by tightening or loosening the locking member 10, so that the connection device is attached to and detached from the signal wire 50 easily and rapidly. In addition, the clamping portions 22 of the first holding member 20 press the electrically conducting plate 30 so that the electrically conducting portion 35 of the electrically conducting plate 30 is connected to the metal foil 52 of the signal wire 50 closely. Further, the electrically conducting portion 35 of the electrically conducting plate 30 has a sword-headed shape so that the electrically conducting plate 30 is inserted into the signal wire 50 rapidly, thereby facilitating the user attaching the connection device to the signal wire 50. Further, the two terminal units 70 and 71 are connected with each other by a single electrically conducting plate without needing addition parts, thereby decreasing the cost of assembly and saving the manual work.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A connection device, comprising:

at least one electrically conducting plate;

at least one first holding member mounted on a first side of the electrically conducting plate;

at least one second holding member mounted on a second side of the electrically conducting plate;

at least one locking member extended through the first holding member, the electrically conducting plate and the second holding member to clamp the electrically conducting plate between the first holding member and the second holding member;

wherein the first holding member has a face formed with a plurality of protruding clamping portions rested on the first side of the electrically conducting plate so that the electrically conducting plate is clamped between the first holding member and the second holding member;

the electrically conducting plate has a distal end protruding outwardly from the first holding member and the second holding member;

the electrically conducting plate has a mounting portion having an end formed with an electrically conducting portion protruding outwardly from the first holding member and the second holding member, and the connection device further comprises a signal wire having a periphery provided with an insulating layer and an inside provided with at least one metal foil located in the insulating layer, wherein the electrically conducting portion of the electrically conducting plate is inserted into the signal wire and electrically connected to the metal foil of the signal wire, the first holding member and the second holding member are rested on the insulating layer of the signal wire.

2. The connection device in accordance with claim 1, wherein the second holding member has a face formed with a flat clamping portion rested on the second side of the electrically conducting plate.

3. The connection device in accordance with claim 1, wherein the electrically conducting portion of the electrically conducting plate has a sword-headed shape and has a size smaller than that of the mounting portion.

4. The connection device in accordance with claim 1, wherein the first holding member has a through hole, the electrically conducting plate has a through hole, the second holding member has a through hole, and the locking member is a locking bolt having a head rested on the first holding member and a threaded shank extended through the through hole of the first holding member, the through hole of the electrically conducting plate and the through hole of the second holding member.

5. The connection device in accordance with claim 1, wherein the connection device comprises two electrically conducting plates laminating each other, a first holding member mounted on a first one of the electrically conducting plates, a second holding member mounted on a second one of the electrically conducting plates, and a locking member extended through the first holding member, the electrically conducting plates and the second holding member to clamp the electrically conducting plates between the first holding member and the second holding member.

6. The connection device in accordance with claim 5, wherein each of the electrically conducting plates has a mounting portion having an end formed with an electrically conducting portion.

7. The connection device in accordance with claim 6, wherein the electrically conducting portion of each of the electrically conducting plates has a sword-headed shape and has a size smaller than that of the mounting portion.

8. The connection device in accordance with claim 6, wherein the electrically conducting portions of the electrically conducting plates are directed toward two opposite directions and are in line with each other.

9. The connection device in accordance with claim 1, wherein the electrically conducting plate has a mounting portion having two opposite ends formed with two opposite electrically conducting portions which are directed toward two opposite directions and are in line with each other.

10. The connection device in accordance with claim 9, wherein each of the electrically conducting portions of the electrically conducting plate has a sword-headed shape and has a size smaller than that of the mounting portion.

11. The connection device in accordance with claim 1, wherein the connection device comprises an electrically conducting plate, two first holding members mounted on a first side of the electrically conducting plate, two second holding members mounted on a second side of the electrically conducting plate, and two locking members each extended through the respective first holding member, the electrically conducting plate and the respective second holding member to clamp the electrically conducting plate between the first holding members and the second holding members.

12. The connection device in accordance with claim 11, wherein the electrically conducting plate has two mounting portions each having an end formed with an electrically conducting portion, and a connection portion located between the two mounting portions.

13. The connection device in accordance with claim 12, wherein the connection portion of the electrically conducting plate has a mediate portion formed with a V-shaped dent.

14. The connection device in accordance with claim 12, wherein the electrically conducting portion of the electrically conducting plate has a sword-headed shape.

15. The connection device in accordance with claim 12, wherein the electrically conducting portions of the electrically conducting plates are directed toward two opposite directions.

16. The connection device in accordance with claim 12, further comprising a signal terminal station having two opposite sides each having a plurality of connecting channels and a plurality of separation walls located between the connecting channels, and a separation channel located between the two opposite sides and connected to the connecting channels for mounting the connection portion.

17. The connection device in accordance with claim 16, wherein each of the connecting channels has a bottom wall formed with a screw bore for screwing the respective locking member, each of the two second holding members is received in the respective connecting channel of the signal terminal station.

* * * * *